US009437150B2

(12) United States Patent
Kawanaka et al.

(10) Patent No.: US 9,437,150 B2
(45) Date of Patent: Sep. 6, 2016

(54) LIQUID CRYSTAL DISPLAY (LCD) DEVICE

(71) Applicant: JVC KENWOOD Corporation, Yokohama-shi (JP)

(72) Inventors: Hiroyuki Kawanaka, Yokohama (JP); Takayuki Iwasa, Yokohama (JP)

(73) Assignee: JVC KENWOOD Corporation, Yokohama-shi (JP)

( * ) Notice: Subject to any disclaimer, the term of this patent is extended or adjusted under 35 U.S.C. 154(b) by 104 days.

(21) Appl. No.: 14/259,983

(22) Filed: Apr. 23, 2014

(65) Prior Publication Data

US 2014/0320482 A1 Oct. 30, 2014

(30) Foreign Application Priority Data

Apr. 26, 2013 (JP) ..... 2013-093542

(51) Int. Cl.
*G09G 3/36* (2006.01)

(52) U.S. Cl.
CPC ..... *G09G 3/3659* (2013.01); *G09G 3/3677* (2013.01); *G09G 2300/0857* (2013.01)

(58) Field of Classification Search
CPC ..... G09G 3/3648; G09G 2300/0857; G09G 2300/0842
See application file for complete search history.

(56) References Cited

U.S. PATENT DOCUMENTS 4,623,925 A * 11/1986 Tults ..... H04N 5/44504 348/537
5,349,366 A * 9/1994 Yamazaki ..... G09G 3/3648 345/206
5,712,652 A * 1/1998 Sato ..... G06F 3/03542 345/204
5,818,412 A * 10/1998 Maekawa ..... G09G 3/3688 345/100
5,959,598 A * 9/1999 McKnight ..... G06T 3/40 345/87
6,005,558 A * 12/1999 Hudson ..... G09G 3/3614 345/204
6,073,261 A * 6/2000 Miller ..... G01R 31/31937 714/724
6,320,572 B1 * 11/2001 Takabayashi ..... G09G 3/3611 345/204

(Continued)

FOREIGN PATENT DOCUMENTS

JP 2001-523847 A 11/2001
JP 2004200300 A * 7/2004
WO WO-99/26226 A1 5/1999

*Primary Examiner* — Dorothy Harris
(74) *Attorney, Agent, or Firm* — Venable LLP; Michael A. Sartori

(57) ABSTRACT

A LCD device includes pixels formed of column data lines and row scanning lines. The pixel includes a display element; a first switching unit that performs sampling on each frame data of an input video signal; a first holding unit that configures an SRAM, and holds sub frame data; a second switching unit that causes the sub frame data held in the first holding unit; and a second holding unit that configures a DRAM, and applies output data to the pixel electrode, a pixel control unit that performs an operation of repeating writing the sub frame data in the first holding unit, turning on the second switching units, and rewriting memory content of the second holding units; and a timing control unit. A delay of a certain period of time is sequentially given to a timing at which the pixel control unit turns on the second switching unit.

12 Claims, 5 Drawing Sheets

(56) References Cited

U.S. PATENT DOCUMENTS 7,663,578 B2 * 2/2010 Miyake ..... G09G 3/3258 315/169.3
8,049,702 B2 * 11/2011 Miyazawa ..... G09G 3/3659 345/100
2001/0005193 A1 * 6/2001 Yokoyama ..... G09G 3/2011 345/92
2001/0052890 A1 * 12/2001 Miyazawa ..... G09G 3/3659 345/89
2002/0075252 A1 * 6/2002 Lee ..... G09G 3/3659 345/211
2002/0084967 A1 * 7/2002 Akimoto ..... G09G 3/3648 345/90
2004/0196235 A1 * 10/2004 Koyama ..... G09G 3/3607 345/89
2008/0238850 A1 * 10/2008 Watanabe ..... G09G 3/3614 345/90
2009/0096947 A1 * 4/2009 Teranishi ..... G02F 1/13306 349/38

* cited by examiner

106: FIRST METALLIC LAYER
108: SECOND METALLIC LAYER
110: THIRD METALLIC LAYER
112: ELECTRODE
114: FOURTH METALLIC LAYER
116: FIFTH METALLIC LAYER
118: CONTACT
119a TO 119e: THROUGH HOLE

LIQUID CRYSTAL DISPLAY (LCD) DEVICE

CROSS-REFERENCE TO RELATED APPLICATIONS

The present application claims priority to and incorporates by reference the entire contents of Japanese Patent Application No. 2013-093542 filed in Japan on Apr. 26, 2013.

BACKGROUND OF THE INVENTION

1. Field of the Invention

The present invention relates to a liquid crystal display (LCD) device, and more particularly, to an LCD device that performs a gradation display by a combination of a plurality of sub frames according to a gradation level represented by a plurality of bits.

2. Description of the Related Art

In the past, a sub frame drive scheme has been known as one of half-tone display schemes used in an LCD device. In the sub frame drive scheme which is a kind of a time axis modulation scheme, a certain period of time (for example, a frame which is a display unit of an image in a case of a moving image) is divided into a plurality of sub frames, and the sub frames are combined according to a gradation to be displayed so as to drive pixels. The gradation to be displayed is decided according to a ratio of a pixel drive period of time occupied in the certain period of time. The ratio of the pixel drive period of time occupied in the certain period of time is decided according to a combination of the divided sub frames.

As an LCD device employing the sub frame drive scheme, known is an LCD device including pixels each of which includes a master latch, a slave latch, an LCD element, and three switching transistors of first to third switching transistors as disclosed in, for example, Japanese Translation of PCT International Application Publication No. JP-T-2001-523847 is known. In this case, in each pixel, first data of one bit is applied to one of two input terminals of the master latch through the first switching transistor; and second data of one bit having a complementary relation with the first data is applied to another input terminal through the second switching transistor. Then, when a target pixel is selected as a row selection signal applied through a row scanning line, the first switching transistor and the second switching transistor are turned on, and the first data is written. When the first data has a logical value of "1" and the second data has a logical value of "0," the pixel performs a display based on data.

After each data is written in all pixels by the above-described operation within a certain sub frame period of time, the third switching transistors of all pixels are turned on within the sub frame period of time. Then, the data written in the master latch is read out to the slave latch with a certain time difference. Then, the data latched in the slave latch is applied to a pixel electrode of the LCD element. The above-described series of operations are repeated at intervals of sub frames, and a desired gradation display is performed based on combinations of all sub frames within one frame period of time.

In other words, in the LCD device employing the sub frame drive scheme, certain display periods of time which are the same as or different from each other are allocated to all sub frames present within one frame period of time. Further, each pixel performs a white display in all sub frames at the time of a maximum gradation display (displayed), but does not perform a white display in all sub frames at the time of a minimum gradation display (not displayed, that is, displayed black). In the case other than at the time of the maximum gradation display or the minimum gradation display, a sub frame to be displayed white is selected according to a gradation to be displayed white. In addition, in the LCD device according to the related art, data to be input is digital data representing a gradation, and a digital drive scheme of a two-stage latch configuration is used.

However, in the LCD device according to the related art, each of the two latches in each pixel is configured with a so-called static random access memory (SRAM), and thus the number of transistors configuring the circuit becomes large. Thus, there is a problem in that it is difficult to reduce the size of a pixel. Further, data written in the two-stage master latches is read out to the slave latch at the same time, and the data latched in the slave latch is applied from the slave latch to the pixel electrode of the LCD element. At this time, however, when switching is performed on all pixels at the same time (at one time), all pixels are read out and thus a consumption current at the moment becomes extremely high. The occurrence of an instantaneous peak of consumption current results in a drop in a power voltage or an increase in a GND voltage, which seriously influences the drive operation of the whole LCD device.

SUMMARY OF THE INVENTION

There is a need to at least partially solve the problems in the conventional technology.

Provided is a liquid crystal display (LCD) device, including a plurality of pixels which are formed at crossing portions at which a plurality of column data lines cross a plurality of row scanning lines. The pixel includes: a display element in which a space, between a pixel electrode and a common electrode opposite to each other, is filled with a liquid crystal and sealed; a first switching unit that performs sampling for a display on each frame data of an input video signal using a plurality of sub frames having a display period of time shorter than one frame period of time through the column data line; a first holding unit that configures an static dynamic random access memory (SRAM) together with the first switching unit, and holds sub frame data obtained by the sampling performed by the first switching unit; a second switching unit that causes the sub frame data held in the first holding unit to be output; and a second holding unit that configures a dynamic random access memory (DRAM) together with the second switching unit, and applies output data, in which memory content is rewritten according to the sub frame data which is held in the first holding unit and is input through the second switching unit, to the pixel electrode, a pixel control unit that performs an operation of repeating writing the sub frame data in the first holding unit in units of rows in the plurality of pixels, turning on the second switching units of all the plurality of pixels by a trigger pulse after the sub frame data is written in all the plurality of pixels, and rewriting memory content of the second holding units of the plurality of pixels according to the sub frame data that is held in the first holding unit, in units of sub frames; and a timing control unit that performs control such that a delay of a certain period of time is sequentially given to a timing at which the pixel control unit turns on the second switching unit in units of rows of pixels. The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
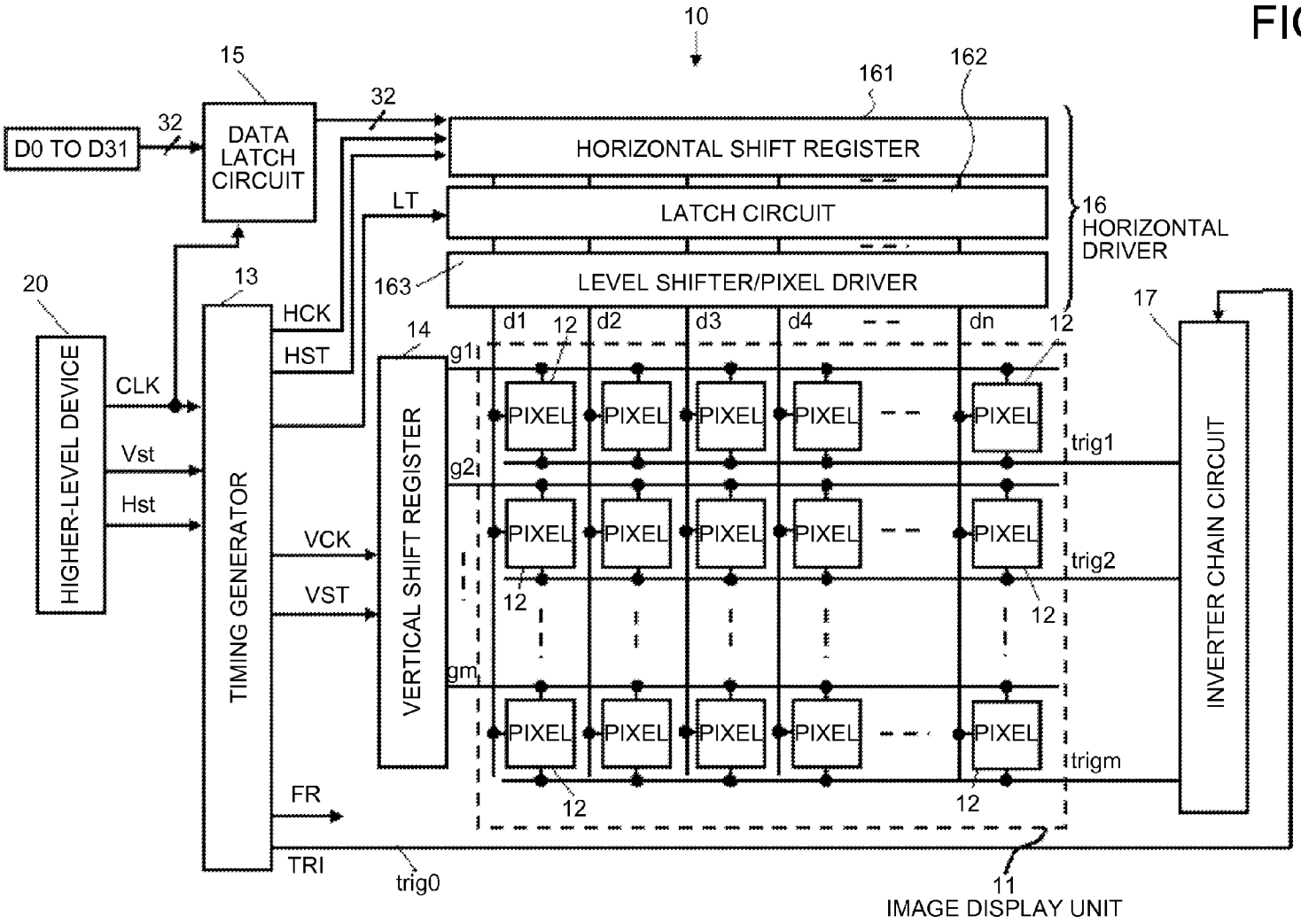
FIG. 1 is a configuration diagram illustrating an LCD device 10 according to an embodiment.

Hereinafter, an exemplary embodiment of the present invention will be described with reference to the appended drawings. FIG. 1 is a block diagram of an LCD device 10 according to an embodiment. The LCD device 10 includes an image display unit 11 in which a plurality of pixels 12 are regularly arranged, a timing generator 13, a vertical shift register 14, a data latch circuit 15, a horizontal driver 16, and an inverter chain circuit 17.

The horizontal driver 16 includes a horizontal shift register 161, a latch circuit 162, and a level shifter/pixel driver 163.

The image display unit 11 includes a total of m×n pixels 12 which are formed at crossing portions at which m row scanning lines g1 to gm (m is a natural number of 2 or more) whose one ends are connected to the vertical shift register 14 and extend in a row direction (an X direction) cross n column data lines d1 to dn (n is a natural number of 2 or more) whose one ends are connected to the level shifter/pixel driver 163 and extend in a column direction (a Y direction), being arranged in the form of a two-dimensional matrix (the image display unit being represented by a block surrounded by a dotted line in FIG. 1). A pixel 12A and a pixel 12B are two neighboring pixels connected to the same row scanning line. All the pixels 12A and 12B in the image display unit are commonly connected to trigger pulse trigger lines trig and trigb whose one ends are connected to a timing generator. All the pixels 12 in the image display unit 11 are commonly connected to m trigger lines trig1 to trigm (m is a natural number of 2 or more) whose one ends are connected to the inverter chain circuit 17 and which extend in the row direction in units of rows.

In FIG. 1, the n column data lines d1 to dn are illustrated as the column data line; but there are cases in which a total of n sets of column data lines, each of which includes a normal data column data line dj and an inverted data column data line dbj, are used. The normal data transmitted through the normal data column data line dj and the inverted data transmitted through the inverted data column data line dbj are data of one bit consistently having an inverse logical value relation (a complementary relation).

Further, in FIG. 1, each of the trigger lines trig1 to trigm is also illustrated by one line, but there are cases in which two trigger lines of normal trigger pulse trigger lines trig1 to trigm and inverted trigger pulse trigger lines trig1 to trigm are used. The normal trigger pulse transmitted through the normal trigger pulse trigger lines trig1 to trigm and the inverted trigger pulse transmitted through the inverted trigger pulse trigger lines trig1 to trigm are consistently in an inverse logical value relation (a complementary relation).

The timing generator 13 receives external signals such as a vertical synchronous signal Vst, a horizontal synchronous signal Hst, and a basic clock CLK from a higher-level device 20 as an input signal. The timing generator 13 generates various kinds of internal signals such as an alternating current signal FR, a V start pulse VST, an H start pulse HST, a clock signal VCK, a clock signal HCK, a latch pulse LT, and a trigger pulse TRI based on the external signals.

Among the internal signals, the alternating current signal FR is a signal whose polarity is reversed at intervals of sub frames. The alternating current signal FR is supplied to a common electrode of an LCD element in the pixels 12 configuring the image display unit 11 as a common electrode voltage Vcom, which will be described later. Switching of sub frames is controlled by the start pulse VST.

The start pulse HST is a pulse signal that is input to the horizontal shift register 161 and output at a start timing. The clock signal VCK is a shift clock specifying one horizontal scanning period of time (1H) in the vertical shift register 14, and the vertical shift register performs a shift operation according to a timing of the clock signal VCK. The clock signal HCK is a shift clock in the horizontal shift register 161 and used to shift data by a 32-bit width.

The latch pulse LT is a pulse signal which is output at a timing at which the horizontal shift register 161 completes shifting data by the number of pixels corresponding to one row in a horizontal direction. The trigger pulse TRI is a pulse signal which is supplied to the inverter chain circuit 17 through the trigger line trig. When the trigger pulse TRI is input, the inverter chain circuit 17 sequentially outputs pulses to the trigger lines trig1 to trigm with a small time difference, and supplies a pulse signal to the pixels in the pixel display unit 11 in units of rows. The trigger pulse TRI is sequentially output to a first signal holding unit (not illustrated in FIG. 1) provided in each of the pixels 12 in the image display unit 11 immediately after writing of data is completed. Further, within the corresponding sub frame period of time, data of the first signal holding unit of each of the pixels 12 in the image display unit 11 is transferred to a second signal holding unit (not illustrated in FIG. 1) in the same pixel within a certain period of time. The first signal holding unit and the second signal holding unit will be described later in detail.

The vertical shift register 14 transfers the V start pulse VST first supplied in each sub frame according to the clock signal VCK. The vertical shift register sequentially and exclusively supplies a row scanning signal to the row scanning lines g1 to gm in units of Hs. As a result, the row scanning lines are sequentially selected one by one at intervals of Hs starting from the row scanning line g1 present at the highest position in the image display unit 11 toward the row scanning line gm present at the lowest position.

The data latch circuit 15 latches data having a 32-bit width divided for each sub frame supplied from an external circuit (not illustrated) based on a basic signal CLK supplied from the higher-level device 20, and then outputs the latched data to the horizontal shift register 161 in synchronization with the basic signal CLK.

Here, in the present embodiment in which one frame of a video signal is divided into a plurality of sub frames having a display period of time shorter than one frame period of time of the video signal so that a gradation display is performed by a combination of the sub frames, in a higher-level configuration circuit present outside the pixels and the peripheral circuits, gradation data representing a gradation of each pixel of the video signal is converted into sub frame data of one bit of each sub frame unit used to indicating a gradation of each pixel in all the plurality of sub frames. Further, in the higher-level configuration circuit present outside the pixels and the peripheral circuits, the sub frame data corresponding to 32 pixels in the same sub frame is supplied to the data latch circuit 15 together as the data having the 32-bit width.

From a point of view in a processing system of one-bit serial data, the horizontal shift register 161 starts shifting according to the H start pulse HST first supplied in one H from the timing generator 13; and shifts data having a 32-bit width supplied from the data latch circuit 15 in synchronization with the clock signal HCK. The latch circuit 162 latches data of n bits (that is, sub frame data corresponding to n pixels in the same row) supplied in parallel from the horizontal shift register 161 according to the latch pulse LT supplied from the timing generator 13 at a point in time in which the horizontal shift register 161 ends shifting data of n bits which are equal to the number n of pixels corresponding to one row in the image display unit 11; and outputs the latched data to a level shifter of the level shifter/pixel driver 163.

When transfer of data to the latch circuit 162 ends, the H start pulse is output from the timing generator 13 again; and the horizontal shift register 161 shifts data having a 32-bit width supplied from the data latch circuit 15 again according to the clock signal HCK.

The level shifter provided in the level shifter/pixel driver 163 shifts signal levels of n pieces of sub frame data, corresponding to n pixels of one row which are latched and supplied by the latch circuit 162, up to a liquid crystal drive voltage. The pixel driver equipped in the level shifter/pixel driver 163 outputs n pieces of sub frame data, corresponding to n pixels of one row after level shifting, to the n data lines d1 to do in parallel.

The horizontal shift register 161, the latch circuit 162, and the level shifter/pixel driver 163 configuring the horizontal driver 16 perform an output of data to a row of pixels in which current data is written within one H, in parallel with shifting of data related to a row of pixels in which data is written within a next H. In a certain horizontal scanning period of time, n pieces of latched sub frame data corresponding to one row are output to the n data lines d1 to dn together in parallel and at the same time as a data signal.

Among the plurality of pixels 12 configuring the image display unit 11, the n pixels 12 of one row selected by the row scanning signal from the vertical shift register 14 perform sampling on n pieces of sub frame data of one row output together from the level shifter/pixel driver 163 through the n data lines d1 to dn; and writes the resultant data into the first signal holding unit (not illustrated in FIG. 1) which will be described later in each of the pixels 12.

Next, the details of the inverter chain circuit 17 will be described with reference to FIG. 2. Each of from INVs 41*a* and 41*b*, INVs 42*a* and 42*b* to INVs 4*ma* and 4*mb* is an inverter circuit configured with a complementary metal oxide semiconductor (CMOS) transistor, and configures an inverter chain circuit in which m×2 or more of inverters (m is a natural number of 2 or more) are connected in series.

A polarity of a TRI signal input to trig0 is reversed by the INV 41*a*, and is output to trigb1. The trigb1 is also an input of the INV 41*b*, of which polarity is reversed by the INV 41*b*, and the resultant signal is output to trig1. For example, when the TRI pulse has the "H" level, trigb1 becomes the "L" level, and trig1 becomes the "H" level. An inverter located behind the INV 42*a* performs the same operation, trigbm becomes the "L" level, and trigm becomes the "H" level.

Here, a time difference occurs between an input and an output of each inverter circuit. For example, a time difference between an input and an output of an inverter circuit is decided according to drive force of a CMOS transistor to be configured, and for example, in the present embodiment, a delay of about 10 ps (picoseconds) per one inverter occurs. Thus, the input signal TRI is output with a time difference of about m×2×10 ps as an output of trigbm.

Figure 3:
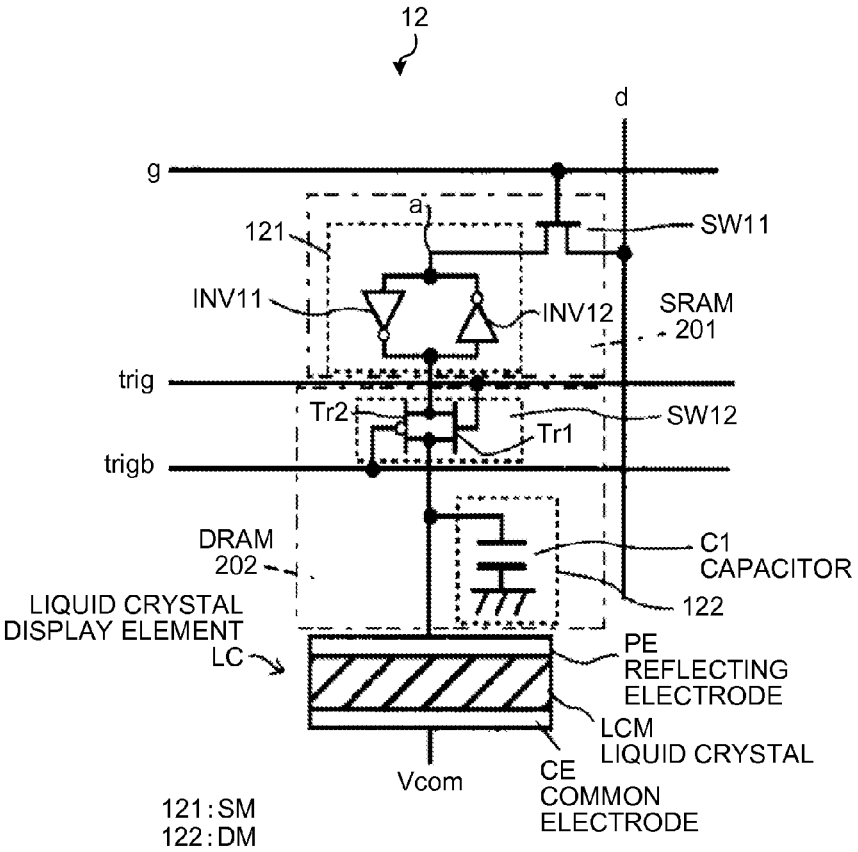
FIG. 3 is a circuit diagram illustrating a pixel 12 according to an embodiment.

Next, embodiments of the pixel 12 which is the main part of the LCD device will be described in detail. FIG. 3 is a circuit diagram of a first embodiment of a pixel which is the main part. In FIG. 3, the pixel 12A of the present embodiment is a pixel formed at a crossing portion of an arbitrary column data line d and an arbitrary row scanning line g in FIG. 1; and includes a static random access memory (SRAM) 201 configured with a switch SW 11 configuring a first switching unit and a first signal holding unit (SM) 121, a dynamic random access memory (DRAM) 202 configured with a switch SW12 configuring a second switching unit and a second signal holding unit (DM) 122, and an LCD element LC. The LCD element LC has a structure in which a space between a reflecting electrode PE and a common electrode CE which are arranged at opposite positions is filled with a liquid crystal LCM and sealed.

The switch SW 11 is configured with an N channel metal oxide semiconductor (MOS) transistor (hereinafter, referred to as an "NMOS transistor") in which a gate is connected to the row scanning line g, a drain is connected to the column data line d, and a source is connected to an input terminal of the SM 121. The SM 121 is a self-holding type memory including two inverters INV11 and INV12 in which an output terminal of one inverter is connected to an input terminal of the other inverter.

Figure 4:
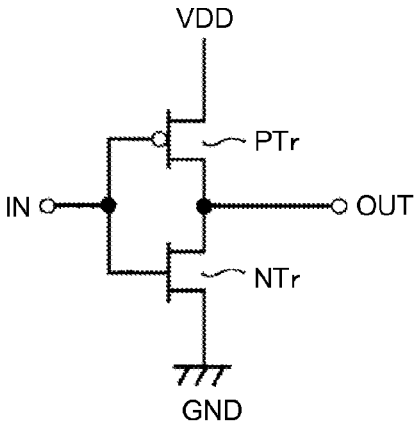
FIG. 4 is a circuit diagram illustrating an inverter according to an embodiment.

The input terminal of the inverter INV11 is connected to the output terminal of the inverter INV12 and the source of the NMOS transistor configuring the switch SW11. The input terminal of the inverter INV12 is connected to the switch SW12 and the output terminal of the inverter INV11. Both the inverter INV11 and the inverter INV12 have a configuration of a CMOS inverter including a P channel MOS transistor (hereinafter, referred to as a "PMOS transistor") PTr and an NMOS transistor NTr in which gates are connected to each other and drains are connected to each other, as illustrated in FIG. 4, but differ in drive force.

In other words, a transistor, having drive force larger than the transistor in the inverter INV12 at the output side configuring the SM 121 from a point of view of the switch SW11, is used as the transistor in the inverter INV11 at the input side configuring the SM 121 from a point of view of the switch SW11. Further, the drive force of the NMOS transistor configuring the switch SW11 is larger than the drive force of the NMOS transistor configuring the inverter INV12.

This is because when data of the SM 121 is rewritten, particularly when a voltage a of the SM 121 at the input side of the switch SW11 has the "L" level and data supplied through the column data line d has the "H" level, the voltage a needs to be higher than an input voltage inverted by the inverter INV11. The voltage a having the "H" level is decided by a ratio of an electric current of the NMOS transistor configuring the inverter INV12 and an electric current of the NMOS transistor configuring the switch SW11. At this time, since the switch SW11 is the NMOS transistor, when the switch SW11 is turned on, a power voltage VDD supplied through the column data line d is not input to the SM 121 due to a threshold voltage Vth of a transistor; and a voltage having the "H" level becomes a voltage which is lower than the VDD by Vth. In addition, at this voltage, an electric current hardly flows since it is driven at around Vth of a transistor. In other words, as the voltage a electrically passing through the switch SW11 increases, an electric current flowing through the switch SW11 decreases.

In other words, when the voltage a has the "H" level, in order to reach a voltage equal to or higher than a voltage inverted by the transistor at the input side of the inverter INV11, an electric current flowing to the switch SW11 needs to be larger than an electric current flowing through the NMOS transistor configuring the transistor of the inverter INV12 at the output side. Thus, since the NMOS transistor configuring the switch SW11 is configured to have the drive force larger than the drive force of the NMOS transistor configuring the inverter INV12, the transistor size of the NMOS transistor configuring the switch SW11 and the transistor size of the NMOS transistor configuring the inverter INV12 need to be decided in view of this fact.

The switch SW12 has a known transmission gate configuration including an NMOS transistor Tr1 and a PMOS transistor Tr2 in which each of the drains is connected each other, and each of the sources is connected each other. The gate of the NMOS transistor Tr1 is connected to the normal trigger pulse trigger line trig, and the gate of the PMOS transistor Tr2 is connected to the inverted trigger pulse trigger line trigb.

Further, one end of the switch SW12 is connected to the SM 121, and the another end thereof is connected to the DM 122 and the reflecting electrode PE of the LCD element LC. Thus, when the normal trigger pulse supplied through the trigger line trig has the "H" level (at this time, the inverted trigger pulse supplied through the trigger line trigb has the "L" level), the switch SW12 is turned on; and so memory data of the SM 121 is read out and is transferred to the DM 122 and the reflecting electrode PE. Further, when the normal trigger pulse supplied through the trigger line trig has the "L" level (at this time, the inverted trigger pulse supplied through the trigger line trigb has the "H" level), the switch SW12 is turned off; and so memory data of the SM 121 is not read out.

Since the switch SW12 has the known transmission gate configuration including the NMOS transistor Tr1 and the PMOS transistor Tr2, the switch SW12 can turn on or off the voltage in the range from the GND to the VDD. In other words, when signals applied to the gates of the NMOS transistor Tr1 and the PMOS transistor Tr2 have the GND potential (the "L" level), the PMOS transistor Tr2 is not brought into conduction; and instead, the NMOS transistor Tr1 is brought into conduction with low resistance.

However, when the gate input signal have the VDD potential (the "H" level), the NMOS transistor Tr1 is not brought into conduction; and instead, the PMOS transistor Tr2 is brought into conduction with low resistance. Thus, the voltage range from the GND to the VDD can be switched with low resistance/high resistance by performing control of turning on or off the transmission gate configuring the switch SW12 by the normal trigger pulse supplied through the trigger line trig and the inverted trigger pulse supplied through the trigger line trigb.

The DM 122 is configured with a capacitor C1. Here, in the case in which memory data of the SM 121 is different from holding data of the DM 122, when the switch SW12 is turned on and the memory data of the SM 121 is transferred to the DM 122, the holding data of the DM 122 needs to be replaced with the memory data of the SM 121.

When the holding data of the capacitor C1 configuring the DM 122 is to be rewritten, the holding data changes according to charging or discharging; and charging and discharging of the capacitor C1 are driven by output signal of the inverter INV11. When the holding data of the capacitor C1 is to be written from the "L" level to the "H" level by charging, the output signal of the inverter INV11 is "H,"; and at this time the PMOS transistor (PTr of FIG. 4) configuring the inverter IVN11 is turned on and the NMOS transistor (NTr of FIG. 4) is turned off, so that the capacitor C1 is charged by the power voltage VDD connected to the source of the PMOS transistor of the inverter INV11.

Meanwhile, when the holding data of the capacitor C1 is to be rewritten from the "H" level to the "L" level by discharging, the output signal of the inverter INV11 has the "L" level; and at this time, the NMOS transistor (NTr of FIG. 4) configuring the inverter INV11 is turned on, and the PMOS transistor (PTr of FIG. 4) is turned off, so that charges accumulated in the capacitor C1 are discharged to the GND through the NMOS transistor (NTr of FIG. 4) of the inverter INV11. The switch SW12 is configured with an analog switch using the above-described transmission gate, and thus can cause the capacitor C1 to be charged or discharged at a high speed.

Further, in the present embodiment, since the drive force of the inverter INV11 is set to be larger than the drive force of the inverter INV12, it is possible to drive the capacitor C1 configuring the DM 122 to be charged or discharged at a high speed. Further, when the switch SW12 is turned on, the charges accumulated in the capacitor C1 have influence on the input gate of the inverter INV12; but as the drive force of the inverter INV11 is set to be larger than the drive force of the inverter INV12, charging and discharging of the capacitor C1 by the inverter INV11 is given higher priority than data input inversion of the inverter INV12, and so it does not happen that the memory data of the SM 121 is rewritten.

When the capacitor C is charged or discharged, a power current or a GND current instantaneously increases. In other words, when the output signal of the inverter INV11 is "H," the capacitor C1 is charged by the power voltage VDD; and when the output signal of the inverter INV11 is "L," the charges accumulated in the capacitor C1 is discharged to the GND, so that an electric current is generated. As the electric current is instantaneously generated, the power voltage drops, or the GND voltage increases; and thus there is a possibility that there will be a problem in that a malfunction or image distortion occurs.

For example, in the case in which a pixel of a 3 μm pitch is configured with a transistor of a power voltage 3.3 V, a pixel display unit includes 4000 pixels in a horizontal direction and 2000 pixels in a vertical direction, and a capacitance of a capacitor C per pixel is set to 10 fF (femtofarad), and when the capacitors C of all pixels of the pixel display unit 11 are charged at once, the power voltage instantaneously drops by 1 V or more, and a malfunction and image distortion occur.

In this regard, the LCD device 10 according to the embodiment employs the following configuration in order to suppress a variation in a voltage. The trigger line trig is connected to an output trigy (y is a natural number of 1 to m) of the inverter chain circuit 17 corresponding to each row of pixels in the pixel display unit. Similarly, the trigger line trigb is connected to an output trigby (y is a natural number of 1 to m) of the inverter chain circuit 17 corresponding to each row of pixels in the pixel display unit.

Figure 2:
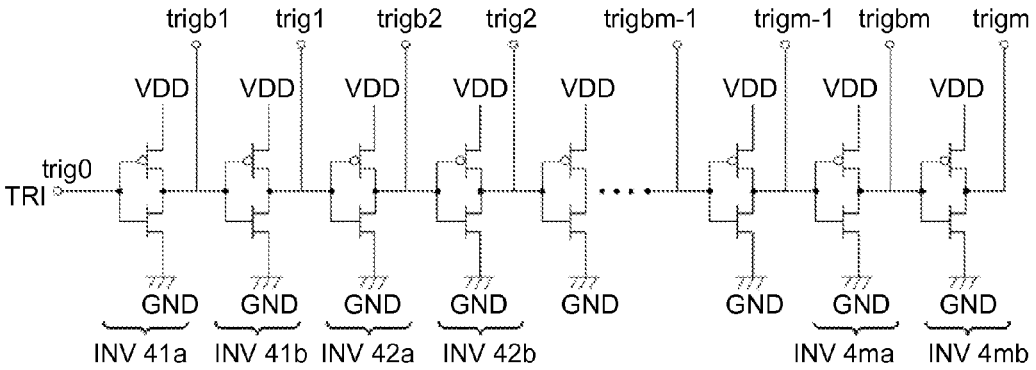
FIG. 2 is a diagram illustrating an exemplary configuration of an inverter chain circuit of the LCD device 10.

Since there is a time difference between an input and an output of each inverter circuit in the inverter chain circuit as described above, the inverter chain circuit 17 operates using the TRI signal supplied from the timing generator 13 as an input pulse, so that the signals trig1 to trigm are sequentially output with a time difference due to a delay in an input and an output of each inverter (from the INVs 41*a* and 41*b*, INVs 42*a* and 42*b* to the INVs 4*ma* and 4*mb* of FIG. 2). In other words, timing control of turning on the switch SW12 and sequentially giving a delay of a certain period of time in units of rows of pixels is performed by using the inverter chain circuit. Further, trigb1 to trigbm consistently have an inverse logical value relation (a complementary relation) with trig1 to trigm. Further, in order to increase a delay amount, it is effective to add inverters of two or more (even number) stages, that is, inverters of 2N stages (N is a natural number) between trig outputs.

As the trig and trigb signals with a time difference are sequentially supplied in units of rows of pixels of the pixel display unit 11 as described above, it is possible to delay an ON timing of the switch SW12; it is possible to average an instantaneous variation in the power voltage and the GND voltage with the charging or discharging of the capacitor C in a time axis direction; and it is possible to prevent a malfunction and image distortion.

Figure 5A:
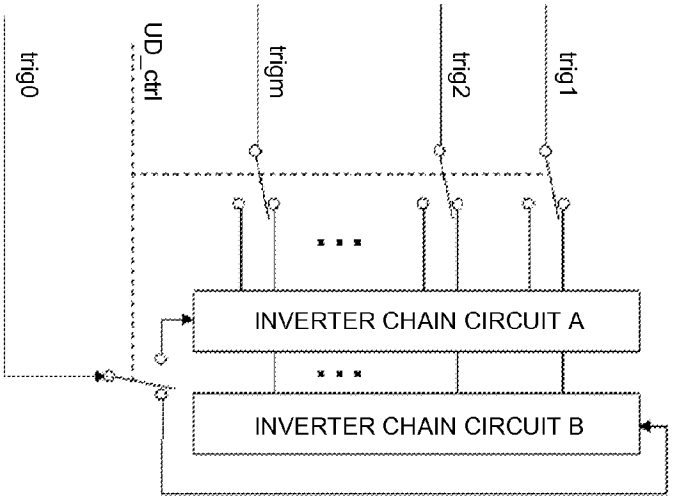
FIGS. 5A and 5B are circuit diagrams illustrating an inverter chain according to an embodiment.

At this time, as another problem, in the above-described embodiment, as there is a slight mismatch in an ON timing of the switch SW12 between pixels in the vertical direction, a luminance difference is likely to occur between pixels in the vertical direction. In this regard, a configuration of an inverter chain for solving the problem is illustrated in FIG. 5A. In this configuration, two inverter chain circuits, whose output shift directions are opposite to each other, are equipped; selecting switches for selecting one of the outputs of the two inverter chain circuits are arranged in units of rows of pixels; the selecting switches are connected to the switch SW12; and the selecting switches perform switching at interval of the sub frames. In other words, two inverter chain circuits, that is, an inverter chain circuit A of shifting in an upward direction and an inverter chain circuit B of shifting in a downward direction are provided; and the two inverter chain circuits are alternately selected at intervals of pixel drive sub frames.

The alternate selection is performed according to a signal UD_ctrl (not illustrated) supplied from the timing generator; an input trig0 of each inverter chain A or B is selected by a switch; and trig1 to trigm and a switch for selecting an output of an inverter chain are switched as well. As a result, the luminance differences in the vertical direction of the screen are averaged in units of sub frames, and thus the entire screen can be uniformly displayed.

Figure 5B:
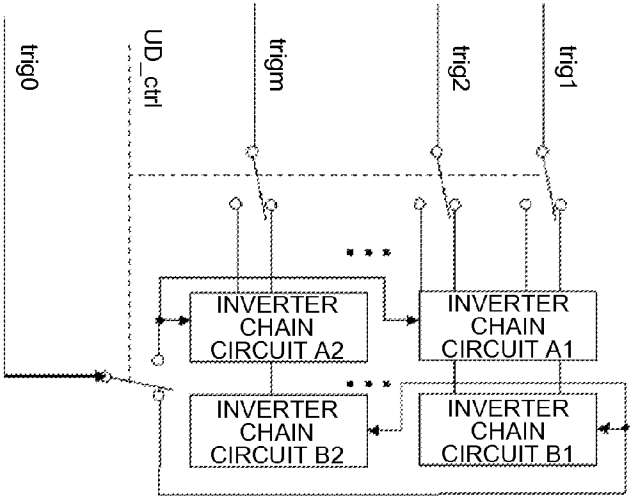

Further, as another problem, when a delay of an inverter chain is too long, a ratio of a delay time to a sub frame period of time increases, so that luminance of a screen is likely to decrease. In this regard, timing control of turning on the switch SW12 and sequentially giving a delay of a certain period of time in units of rows of pixels is performed by using a plurality of inverter chain circuits divided in units of rows of pixels in the row direction. In this case, the inverter chain circuits start to be driven at the same time according to a common trigger pulse. FIG. 5B illustrates a configuration of an inverter chain in this case. In the configuration of FIG. 5B, compared to the configuration of FIG. 5A, the inverter chain circuit is vertically divided into two; four inverter chain circuits, that is, inverter chain circuits A1 and A2 of shifting in an upward direction and inverter chain circuits B1 and B2 of shifting in a downward direction are provided; and the inverter chain circuits A1 and A2 and the inverter chain circuits B1 and B2 are alternately selected at intervals of pixel drive sub frames.

The alternate selection is performed according to a signal UD_ctrl (not illustrated) supplied from the timing generator; an input trig0 of each inverter chain A1 and A2 or B1 and B2 is selected by a switch; and trig1 to trigm are switched by a switch selecting an output of an inverter chain as well. In this case, a delay time per inverter chain from a first stage to a last stage halves; and a ratio of a delay time to a sub frame period of time can be also reduced, so that a decrease in a screen luminance can be suppressed. Further, the inverter chain is preferably configured such that vertical shift directions are opposite to each other in a left-right combination, and for example, it is preferable that the inverter chain circuit A2 be configured to shift in the downward direction, and the inverter chain B2 be configured to shift in the upward direction. The inverter chain may be vertically divided into three or more other than two, and the optimal number of divisions is preferably decided according to a consumption current amount.

Further, each of the SRAM 201 and the DRAM 202 may be configured with a two-stage DRAM including a capacitor and a switch; but in this case, when a capacitor used instead of the SM 121 and a capacitor configuring a DM are brought into conduction, charges are neutralized so that it is difficult to get the amplitude of the GND and VDD voltages. On the other hand, according to the pixel 12A illustrated in FIG. 3, it is possible to transfer 1-bit data from the SM 121 to the DM 122 with the amplitude of the GND and VDD voltages; it is possible to set an applying voltage of the LCD element LC to a high value when driven at the same power voltage; and thus it is possible to get a large dynamic range.

Further, a configuration in which the SRAM 201 is changed into a configuration including a capacitor and a switch, and the DRAM 202 is changed into an SRAM may be considered, but in this case, there is a problem in that an operation is unstable compared to the pixel 12A of the present embodiment of FIG. 3. In other words, in the case of the above configuration, it is necessary to rewrite memory data of the SRAM used instead of the DM 122 with charges accumulated in the capacitor used instead of the SM 121; but since a data holding capability of a memory by the SRAM is typically stronger than a charge holding capability of the capacitor, there is a possibility that there will be a problem in that charges of the capacitor used instead of the SM 121 of a previous stage is rewritten with memory data of an SRAM used instead of the DM 122. Further, in this case, since a large capacitor needs to be used in order to prevent the capacitor used instead of the SM 121 from being rewritten with data of an SRAM of a subsequent stage, a pixel pitch increases; and thus there is a problem in that it is difficult to reduce the size of a pixel.

According to the pixel 12A of the present embodiment illustrated in FIG. 3, not only effects of being able to set the applying voltage of the LCD element LC to a high value as described above and get a large dynamic range but also a large effect of being able to reduce the size of a pixel is obtained. A reduction in the size of a pixel can be achieved because each of the inverter INV11 and the inverter INV12 is configured with two transistors as illustrated in FIG. 3, a pixel includes a total of seven transistors and a single capacitor C1 and so can be configured with a smaller number of elements than a pixel according to a related art; and also as will be described later, it is possible to effectively arrange the SM 121, the DM 122, and the reflecting electrode PE in a height direction of an element.

Figure 6:
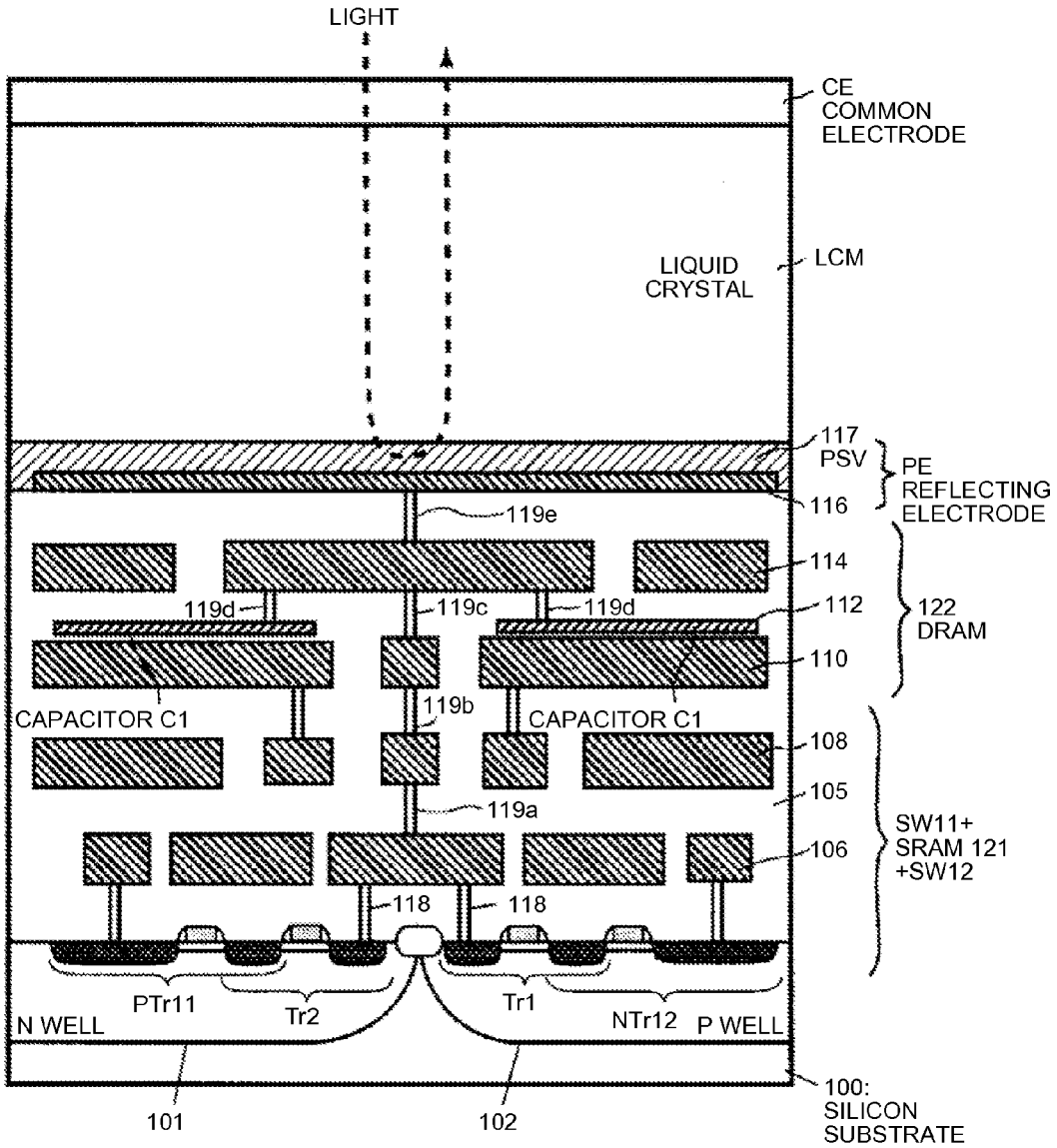
FIG. 6 is a diagram illustrating an exemplary cross-sectional structure of a pixel 12 according to an embodiment.

FIG. 6 is a cross-sectional configuration diagram of an embodiment of a pixel which is a main part of an LCD device. As the capacitor C1 illustrated in FIG. 3, a metal-insulator-metal (MIM) capacitor in which a capacitor is formed between interconnections, a diffusion capacitor in which a capacitor is formed between a substrate and polysilicon, a poly-insulator-poly (PIP) capacitor in which a capacitor is formed between two polysilicon layers, or the like can be used. FIG. 6 is a cross-sectional configuration diagram of an LCD device in which the capacitor C1 has an MIM configuration.

Referring to FIG. 6, a PMOS transistor PTr11 of the inverter INV11 and a PMOS transistor Tr2 of the switch SW12 are formed on an N well 101 formed in a silicon substrate 100 such that a diffusion layer serving as a drain is shared by the two transistors and so drains of the two transistors are connected to each other. Further, an NMOS transistor NTr12 of the inverter INV12 and an NMOS transistor Tr1 of the switch SW12 are formed on a P well 102 formed in the silicon substrate 100 such that a diffusion layer serving as a drain is shared by the two transistors and so drains of the two transistors are connected to each other. The NMOS transistor configuring the inverter INV11 and the PMOS transistor configuring the inverter INV12 are not illustrated in FIG. 6.

Further, above the transistors PTr11, Tr2, Tr1, and NTr12, a first metallic layer 106, a second metallic layer 108, a third metallic layer 110, an electrode 112, a fourth metallic layer 114, and a fifth metallic layer 116 are stacked such that an inter-layer insulating film 105 is interposed between the metallic layers. The fifth metallic layer 116 configures reflecting electrode PE formed for each pixel. The diffusion layers configuring the sources of the NMOS transistor Tr1 and the PMOS transistor Tr2 configuring the switch SW12 are electrically connected to the first metallic layer 106 through a contact 118, and are electrically connected to the second metallic layer 108, the third metallic layer 110, the fourth metallic layer 114, and the fifth metallic layer 116 through holes 119*a*, 119*b*, 119*c*, and 119*e*. In other words, the sources of the NMOS transistor Tr1 and the PMOS transistor Tr2 configuring the switch SW12 are electrically connected to the reflecting electrode PE.

Further, a passivation film (PSV) 117 is formed on the reflecting electrode PE (the fifth metallic layer 116) as a protection film, apart from the common electrode CE which is a transparent electrode at an opposite position. A space between the pixel electrode PE and the common electrode CE is filled with the liquid crystal LCM and sealed, thereby configuring the LCD element LC.

Here, the electrode 112 is formed above the third metallic layer 110 with the inter-layer insulating film 105 interposed therebetween. The electrode 112 configures the capacitor C1 together with the inter-layer insulating film 105 between the third metallic layer 110 and the third metallic layer 110. When the capacitor C1 has the MIM structure, the SM 121, the switch SW11, and the switch SW12 can be formed using the transistor and interconnections of the first metallic layer 106 and the second metallic layer 108; and the DM 122 can be formed by an MIM interconnection using the third metallic layer 110 above the transistor. The electrode 112 is electrically connected to the fourth metallic layer through the through hole 119*d*; and the fourth metallic layer 114 is electrically connected to the reflecting electrode PE through the through hole 119*e*; and thus the capacitor C1 is electrically connected to the reflecting electrode PE.

Light, emitted from a light source (not illustrated) transmits the common electrode CE and the liquid crystal LCM, is incident on the reflecting electrode PE (the fifth metallic layer 116); reflected by the reflecting electrode PE; reversely goes along an original incident path; and exits through the common electrode CE.

According to the present embodiment, as illustrated in FIG. 6, the fifth metallic layer 116 which is a fifth interconnection layer is allocated to the reflecting electrode PE, and thus the SM 121, the DM 122, and the reflecting electrode PE can be effectively arranged in the height direction, whereby a reduction in the size of a pixel can be achieved. As a result, a pixel having a pitch of 3 μm or less can be configured with a transistor of a power voltage 3.3 V. Through the pixels having the pitch of 3 μm, it is possible to implement a liquid crystal display panel of which a diagonal length is 0.55 inches, 4000 pixels are arranged in the horizontal direction, and 2000 pixels are arranged in the vertical direction.

Next, an operation of the LCD device 10 using the pixel 12A of the present embodiment will be described with reference to a timing chart of FIG. 7.

As described above, in the LCD device 10 of FIG. 1, since the row scanning lines are sequentially selected one by one from the row scanning line g1 toward the row scanning line gm at intervals of Hs according to the row scanning signal supplied from the vertical shift register 14, the plurality of pixels 12 (12A) configuring the image display unit 11 write data in units of n pixels of one row commonly connected to the selected row scanning line. Then, when writing ends in all the plurality of pixels 12 (12A) configuring the image display unit 11, data is read out from all pixels based on the trigger pulse within a certain period of time.

Figure 7:
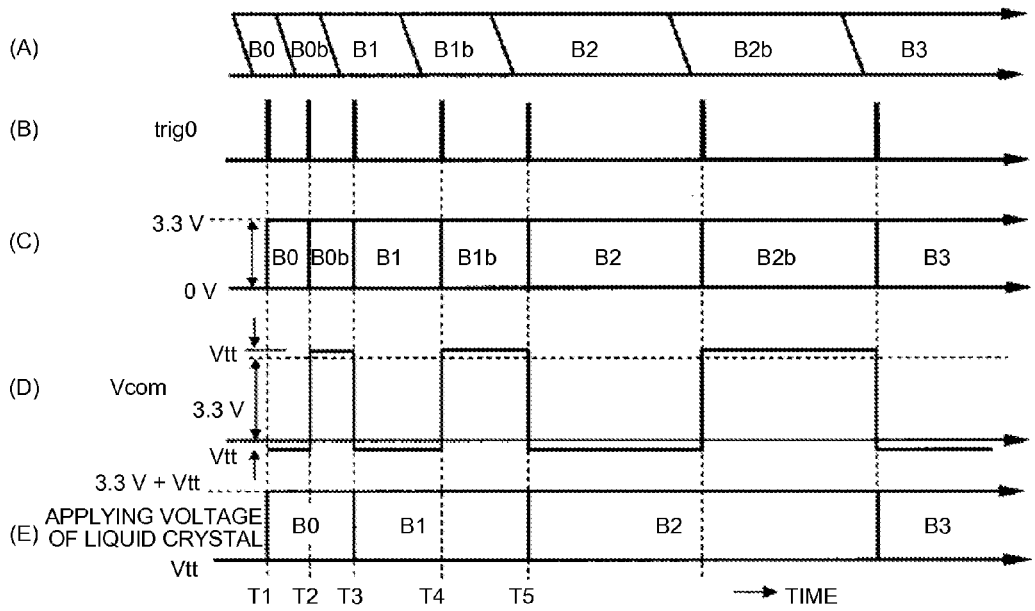
FIG. 7 is an explanatory diagram for describing multiplexing a saturation voltage of a liquid crystal of the LCD device 10 and a threshold voltage of the liquid crystal into binary-weighted pulse width modulation data.

(A) of FIG. 7 schematically illustrates a writing period of time and a reading period of time of a pixel for one-bit sub frame data to be output from the horizontal driver 16 to the column data line d (d1 to dn). A left-downward oblique line represents a writing period of time. In (A) of FIG. 7, B0*b*, B1*b*, and B2*b* represent inverted data of data of bits B0, B1, and B2. (B) of FIG. 7 illustrates a trigger pulse that is output from the timing generator 13 to the normal trigger pulse trigger line trig0. The trigger pulse is output at intervals of sub frames. As described above, trig0 is output to trig1 to trigm through the inverter chain circuit 17 with a time difference. Here, since the time difference is slight, its illustration is not presented.

First, when the pixel 12A is selected by the row scanning signal, the switch SW11 is turned on; and the normal sub frame data of the bit B0 of (A) of FIG. 7 to be output to the column data line d is sampled by the switch SW11 and written into the SM 121 of the pixel 12A. Similarly, the sub frame data of the bit B0 is written into the SM 121 of all the pixels 12A configuring the image display unit 11; and at a time T1 illustrated in FIG. 7 after the writing operation ends, as illustrated in (B) of FIG. 7, the normal trigger pulse having the "H" level is supplied to all the pixels 12A configuring the image display unit 11 through the inverter chain circuit 17 with a certain time difference.

Through this operation, the switches SW12 of all the pixels 12A are turned on, the normal sub frame data of the bit B0 stored in the SM 121 is collectively transferred to and held in the capacitor C1 configuring the DM 122 through the switch SW12, and applied to the reflecting electrode PE. A holding period of time, in which the capacitor C1 holds the normal sub frame data of the bit B0, is one sub frame period of time from the time T1 to a time T2 at which a next normal trigger pulse having the "H" level is input as illustrated in (B) of FIG. 7. (C) of FIG. 7 schematically illustrates bits of the sub frame data applied to the reflecting electrode PE.

Here, when the bit value of the sub frame data is "1," that is, the "H" level, the power voltage VDD (Here, 3.3 V) is applied to the reflecting electrode PE; and when the bit value is "0," that is, the "L" level, 0 V is applied to the reflecting electrode PE. Meanwhile, a free voltage which is not limited to the GND or the VDD can be applied to the common electrode CE of the LCD element LC as the common electrode voltage Vcom; and a specified voltage is applied to the common electrode CE of the LCD element LC at the same time as when the normal trigger pulse having the "H" level is input. Here, the common electrode voltage Vcom is set to a voltage which is lower than 0 V by a threshold voltage Vtt of the liquid crystal during the sub frame period of time in which the normal sub frame data is applied to the reflecting electrode PE as illustrated in (D) of FIG. 7.

The LCD element LC performs the gradation display according to the applying voltage of the liquid crystal LCM which is an absolute value of a voltage difference between the applying voltage of the reflecting electrode PE and the common electrode voltage Vcom. Thus, in the one sub frame period of time from the time T1 to the time T2 in which the normal sub frame data of the bit B0 is applied to the reflecting electrode PE, the applying voltage of the liquid crystal LCM is 3.3 V+Vtt (=3.3 V−(−Vtt)) when the bit value of the sub frame data is "1"; and is +Vtt (=0 V−(−Vtt)) when the bit value of the sub frame data is "0" as illustrated in (E) of FIG. 7.

Figure 8:
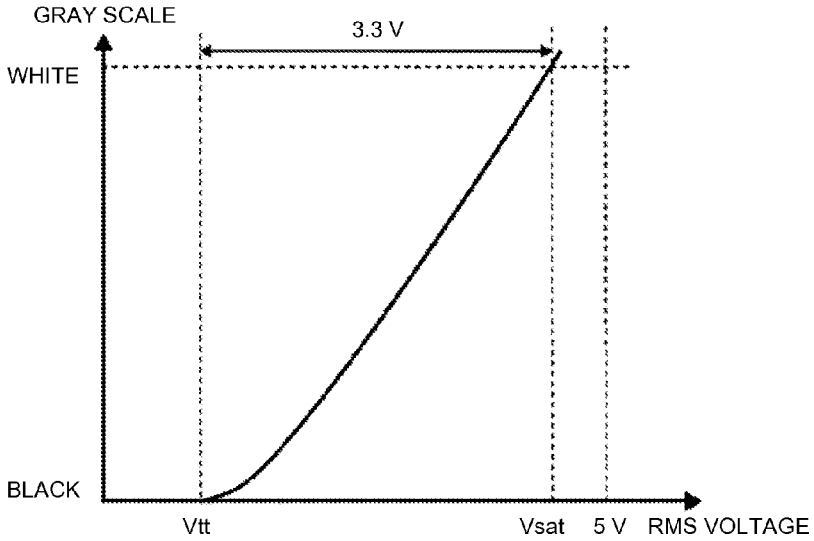
FIG. 8 illustrates a relation between an applying voltage (an RMS voltage) of the liquid crystal and a gray scale value of the liquid crystal.

FIG. 8 illustrates a relation between an applying voltage (an RMS voltage) of the liquid crystal and a gray scale value of the liquid crystal. As illustrated in FIG. 8, a gray scale value curve is shifted such that a black gray scale value corresponds to the RMS voltage of the threshold voltage Vtt of the liquid crystal, and a white gray scale value corresponds to an RMS voltage of a saturation voltage Vsat (=3.3 V+Vtt) of the liquid crystal. It is possible to cause the gray scale value to match an effective portion of a liquid crystal response curve. Thus, the LCD element LC displays white when the applying voltage of the liquid crystal LCM is (3.3 V+Vtt) and black when the applying voltage of the liquid crystal LCM is +Vtt as described above.

Then, in the sub frame period of time in which the normal sub frame data of the bit B0 is displayed, the inverted sub frame data of the bit B0 sequentially starts to be written in the SM 121 of the pixel 12A as indicated by B0*b* in (A) of FIG. 7. Then, the inverted sub frame data of the bit B0 is written in the SMs 121 of all the pixels 12A of the image display unit 11; and at the time T2 after the writing ends, as illustrated in (B) of FIG. 7, the normal trigger pulse having the "H" level is supplied to all the pixels 12A configuring the image display unit 11 through the inverter chain circuit 17 with a certain time difference.

Through this operation, the switches SW12 of all the pixels 12A are turned on, and thus the inverted sub frame data of the bit B0 stored in the SM 121 is transferred to and held in the capacitor C1 configuring the DM 122 through the switch SW12, and applied to the reflecting electrode PE. A holding period of time in which the capacitor C1 holds the inverted sub frame data of the bit B0 is one sub frame period of time from the time T2 to a time T3 at which a next normal trigger pulse having the "H" level is input as illustrated in (B) of FIG. 7. Here, since the inverted sub frame data of the bit B0 consistently has an inverse logical value relation with the normal sub frame data of the bit B0, the inverted sub frame data of the bit B0 is "0" when the normal sub frame data of the bit B0 is "1" and "1" when the normal sub frame data of the bit B0 is "0."

Meanwhile, the common electrode voltage Vcom is set to a voltage which is higher than 3.3 V by the threshold voltage Vtt of the liquid crystal during the sub frame period of time in which the inverted sub frame data is applied to the reflecting electrode PE as illustrated in (D) of FIG. 7. Thus, in the one sub frame period of time from the time T2 to the time T3 in which the inverted sub frame data of the bit B0 is applied to the reflecting electrode PE, the applying voltage of the liquid crystal LCM is −Vtt (=3.3 V−(3.3 V+Vtt)) when the bit value of the sub frame data is "1"; and is −3.3 V−Vtt (=0 V−(3.3 V+Vtt)) when the bit value of the sub frame data is "0."

Thus, when the bit value of the normal sub frame data of the bit B0 is "1," since the bit value of the inverted sub frame data of the bit B0 which is subsequently input is "0," the applying voltage of the liquid crystal LCM is −(3.3 V+Vtt); and since potential applied to the liquid crystal LCM has an opposite direction to but the same absolute value as at the time of the normal sub frame data of the bit B0, the pixel 12A displays white which is the same when the normal sub frame data of the bit B0 is displayed. Similarly, when the bit value of the normal sub frame data of the bit B0 is "0," since the bit value of the inverted sub frame data of the bit B0 which is subsequently input is "1," the applying voltage of the liquid crystal LCM is −Vtt; and since potential applied to the liquid crystal LCM has an opposite direction to but the same absolute value as at the time of the normal sub frame data of the bit B0, the pixel 12A displays black.

Thus, during the two sub frame periods of time from the time T1 to the time T3, as illustrated in (E) of FIG. 7, the pixel 12A displays the same gradation for the bit B0 and the complementary bit B0*b* of the bit B0; and since alternating current drive of reversing the potential direction of the liquid crystal LCM at intervals of sub frames is performed, burning-in of the liquid crystal LCM can be prevented.

Then, in the sub frame period of time in which the inverted sub frame data of the complementary bit B0*b* is displayed, the normal sub frame data of the bit B1 sequentially starts to be written in the SM 121 of the pixel 12A as indicated by B1 in (A) of FIG. 7. Then, the normal sub frame data of the bit B1 is written in the SMs 121 of all the pixels 12A of the image display unit 11; and at the time T3 after the writing ends, as illustrated in (B) of FIG. 7, the normal trigger pulse having the "H" level is supplied to all the pixels 12A configuring the image display unit 11 through the inverter chain circuit 17 with a certain time difference.

Through this operation, the switches SW12 of all the pixels 12A are turned on, and thus the normal sub frame data of the bit B1 stored in the SM 121 is transferred to and is held in the capacitor C1 configuring the DM 122 through the switch SW12; and applied to the reflecting electrode PE. A holding period of time in which the capacitor C1 holds the normal sub frame data of the bit B1 is one sub frame period of time from the time T3 to a time T4 at which a next normal trigger pulse having the "H" level is input as illustrated in (B) of FIG. 7.

Meanwhile, the common electrode voltage Vcom is set to a voltage which is lower than 0 V by the threshold voltage Vtt of the liquid crystal during the sub frame period of time in which the normal sub frame data is applied to the reflecting electrode PE as illustrated in (D) of FIG. 7. Thus, in the one sub frame period of time from the time T3 to the time T4 in which the normal sub frame data of the bit B1 is applied to the reflecting electrode PE, as illustrated in (E) of FIG. 7, the applying voltage of the liquid crystal LCM is 3.3 V+Vtt (=3.3 V−(−Vtt)) when the bit value of the sub frame data is "1"; and is +Vtt (=0 V−(−Vtt)) when the bit value of the sub frame data is "0."

Then, in the sub frame period of time in which the normal sub frame data of the bit B1 is displayed, the inverted sub frame data of the bit B1 sequentially starts to be written in the SM 121 of the pixel 12A as indicated by B1*b* in (A) of FIG. 7. Then, the inverted sub frame data of the bit B1 is written in the SMs 121 of all the pixels 12A of the image display unit 11; and at the time T4 after the writing ends, as illustrated in (B) of FIG. 7, the normal trigger pulse having the "H" level is supplied to all the pixels 12A configuring the image display unit 11 through the inverter chain circuit 17 with a certain time difference.

Through this operation, the switches SW12 of all the pixels 12A are turned on, and thus the inverted sub frame data of the bit B1 stored in the SM 121 is transferred to and is held in the capacitor C1 configuring the DM 122 through the switch SW12; and applied to the reflecting electrode PE. A holding period of time in which the capacitor C1 holds the inverted sub frame data of the bit B0 is one sub frame period of time from the time T4 to a time T5 at which a next normal trigger pulse having the "H" level is input as illustrated in (B) of FIG. 7. Here, the inverted sub frame data of the bit B1 consistently has an inverse logical value relation with the normal sub frame data of the bit B1.

Meanwhile, the common electrode voltage Vcom is set to a voltage which is higher than 3.3 V by the threshold voltage Vtt of the liquid crystal during the sub frame period of time in which the inverted sub frame data is applied to the reflecting electrode PE as illustrated in (D) of FIG. 7. Thus, in the one sub frame period of time from the time T4 to the time T5 in which the inverted sub frame data of the bit B1 is applied to the reflecting electrode PE, the applying voltage of the liquid crystal LCM is −Vtt (=3.3 V−(3.3 V+Vtt)) when the bit value of the sub frame data is "1"; and is −3.3 V−Vtt (=0 V−(3.3 V+Vtt)) when the bit value of the sub frame data is "0."

As a result, during the two sub frame periods of time from the time T3 to the time T5, as illustrated in (E) of FIG. 7, the pixel 12A displays the same gradation for the bit B1 and the complementary bit B1*b* of the bit B1; and since alternating current drive of reversing the potential direction of the liquid crystal LCM at intervals of sub frames is performed, burning-in of the liquid crystal LCM can be prevented. Then, the above-described operation is repeated, and the LCD device including the pixel 12A of the present embodiment can display the gradation display according to a combination of a plurality of sub frames.

Further, the display periods of time of the bit B0 and the complementary bit B0*b* are the same frame period of time, that is, a first sub frame period of time; and the display periods of time of the bit B1 and the complementary bit B1*b* are the same frame period of time, that is, a second sub frame period of time; but the first sub frame period of time and the second sub frame period of time are not limited to be the same. Here, as an example, the second sub frame period of time is set to be twice as long as the first sub frame period of time. Further, as illustrated in (E) of FIG. 7, a third sub frame period of time which is a display period of time of the bit B2 and the complementary bit B2*b* is set to be twice as long as the second sub frame period of time. The same applies to other sub frame periods of time, and a certain length is decided as the length of each sub frame period of time depending on a system, and an arbitrary number is decided as the number of sub frames.

According to the present invention, it is possible to provide an LCD device which is capable of implementing a small-sized pixel configuration and performing a stable image display by suppressing an instantaneous increase in a consumption current and stabilizing a power voltage or a GND voltage even when a pixel is configured by a two-stage latch configuration.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A liquid crystal display (LCD) device, comprising:

a plurality of pixels which are formed at crossing portions at which a plurality of column data lines cross a plurality of row scanning lines, wherein the pixel comprises:

a display element in which a space, between a pixel electrode and a common electrode opposite to each other, is filled with a liquid crystal and sealed;

a first switching unit that performs sampling for a display on each frame data of an input video signal using a plurality of sub frames having a display period of time shorter than one frame period of time through the column data line;

a first holding unit that configures an static dynamic random access memory (SRAM) together with the first switching unit, and holds sub frame data obtained by the sampling performed by the first switching unit;

a second switching unit that causes the sub frame data held in the first holding unit to be output; and a second holding unit that configures a dynamic random access memory (DRAM) together with the second switching unit, and applies output data, in which memory content is rewritten according to the sub frame data which is held in the first holding unit and is input through the second switching unit, to the pixel electrode, a pixel control unit that performs an operation of repeating writing the sub frame data in the first holding unit in units of rows in the plurality of pixels, turning on the second switching units of all the plurality of pixels by a trigger pulse after the sub frame data is written in all the plurality of pixels, and rewriting memory content of the second holding units of the plurality of pixels according to the sub frame data that is held in the first holding unit, in units of sub frames; and a timing control unit that is composed of an inverter chain circuit that performs control such that a delay of a certain period of time is sequentially given to a timing at which the pixel control unit turns on the second switching unit in units of rows of pixels, wherein the inverter chain circuit is composed at least of a plurality of inverters as well as trigger pulse lines and inverted trigger pulse lines which connect the pixels to the plurality of the inverters, and further inverters of 2N stages (N: a natural number) are provided between an input terminal of one inverter whose output terminal is connected to one trigger pulse line and an output terminal of another inverter adjacent to the one inverter whose input terminal is connected to another trigger pulse line.

2. The LCD device according to claim 1, wherein the second holding unit is configured with a capacitor, and the second switching unit is configured with a transmission gate in which switching control is performed according to two trigger pulses having opposite polarities.

3. The LCD device according to claim 2, wherein multiple interconnection layers are formed above a substrate including two transistors configuring the transmission gate which are formed on a surface thereof, the capacitor is formed by an electrode formed between an intermediate interconnection layer among the multiple interconnection layers and an inter-layer insulating film, and the pixel electrode is formed of an topmost interconnection layer among the multiple interconnection layers.

4. The LCD device according to claim 1, wherein the first switching unit is configured with a first transistor, the first holding unit is configured with first inverter and second inverter each of which output terminal is connected to input terminal of the other inverter, of the first inverter and second inverter, drive force of a second transistor configuring the first inverter at an input side from a view point of the first transistor is set to be larger than drive force of a third transistor configuring the second inverter at an output side from a view point of the first transistor, and drive force of the first transistor is set to be larger than the drive force of the third transistor configuring the second inverter.

5. A liquid crystal display (LCD) device, comprising:

a plurality of pixels which are formed at crossing portions at which a plurality of column data lines cross a plurality of row scanning lines, wherein the pixel comprises:

a display element in which a space, between a pixel electrode and a common electrode opposite to each other, is filled with a liquid crystal and sealed;

a first switching unit that performs sampling for a display on each frame data of an input video signal using a plurality of sub frames having a display period of time shorter than one frame period of time through the column data line;

a first holding unit that configures an static dynamic random access memory (SRAM) together with the first switching unit, and holds sub frame data obtained by the sampling performed by the first switching unit;

a second switching unit that causes the sub frame data held in the first holding unit to be output; and a second holding unit that configures a dynamic random access memory (DRAM) together with the second switching unit, and applies output data, in which memory content is rewritten according to the sub frame data which is held in the first holding unit and is input through the second switching unit, to the pixel electrode, a pixel control unit that performs an operation of repeating writing the sub frame data in the first holding unit in units of rows in the plurality of pixels, turning on the second switching units of all the plurality of pixels by a trigger pulse after the sub frame data is written in all the plurality of pixels, and rewriting memory content of the second holding units of the plurality of pixels according to the sub frame data that is held in the first holding unit, in units of sub frames; and a timing control unit that is composed of an inverter chain circuit that performs control such that a delay of a certain period of time is sequentially given to a timing at which the pixel control unit turns on the second switching unit in units of rows of pixels, wherein the timing control unit is composed of a plurality of the inverter chain circuits divided in units of rows of pixels in a row direction and each inverter chain circuit starts to be driven at the same time according to a common trigger pulse.

6. The LCD device according to claim 5, wherein the second holding unit is configured with a capacitor, and the second switching unit is configured with a transmission gate in which switching control is performed according to two trigger pulses having opposite polarities.

7. The LCD device according to claim 6, wherein multiple interconnection layers are formed above a substrate including two transistors configuring the transmission gate which are formed on a surface thereof, the capacitor is formed by an electrode formed between an intermediate interconnection layer among the multiple interconnection layers and an inter-layer insulating film, and the pixel electrode is formed of an topmost interconnection layer among the multiple interconnection layers.

8. The LCD device according to claim 5, wherein the first switching unit is configured with a first transistor, the first holding unit is configured with first inverter and second inverter each of which output terminal is connected to input terminal of the other inverter, of the first inverter and second inverter, drive force of a second transistor configuring the first inverter at an input side from a view point of the first transistor is set to be larger than drive force of a third transistor configuring the second inverter at an output side from a view point of the first transistor, and drive force of the first transistor is set to be larger than the drive force of the third transistor configuring the second inverter.

9. A liquid crystal display (LCD) device, comprising:

a plurality of pixels which are formed at crossing portions at which a plurality of column data lines cross a plurality of row scanning lines, wherein the pixel comprises:

a display element in which a space, between a pixel electrode and a common electrode opposite to each other, is filled with a liquid crystal and sealed;

a first switching unit that performs sampling for a display on each frame data of an input video signal using a plurality of sub frames having a display period of time shorter than one frame period of time through the column data line;

a first holding unit that configures an static dynamic random access memory (SRAM) together with the first switching unit, and holds sub frame data obtained by the sampling performed by the first switching unit;

a second switching unit that causes the sub frame data held in the first holding unit to be output; and a second holding unit that configures a dynamic random access memory (DRAM) together with the second switching unit, and applies output data, in which memory content is rewritten according to the sub frame data which is held in the first holding unit and is input through the second switching unit, to the pixel electrode, a pixel control unit that performs an operation of repeating writing the sub frame data in the first holding unit in units of rows in the plurality of pixels, turning on the second switching units of all the plurality of pixels by a trigger pulse after the sub frame data is written in all the plurality of pixels, and rewriting memory content of the second holding units of the plurality of pixels according to the sub frame data that is held in the first holding unit, in units of sub frames; and a timing control unit that is composed of an inverter chain circuit that performs control such that a delay of a certain period of time is sequentially given to a timing at which the pixel control unit turns on the second switching unit in units of rows of pixels, wherein the timing control unit is composed of two inverter chain circuits whose output shift directions are opposite to each other and selecting switches for selecting one of the outputs of the two inverter chain circuits which are arranged in units of rows of pixels, and the selecting switches are connected to the second switching unit to perform switching of the selecting switches at interval of the sub frames.

10. The LCD device according to claim 9, wherein the second holding unit is configured with a capacitor, and the second switching unit is configured with a transmission gate in which switching control is performed according to two trigger pulses having opposite polarities.

11. The LCD device according to claim 10, wherein multiple interconnection layers are formed above a substrate including two transistors configuring the transmission gate which are formed on a surface thereof, the capacitor is formed by an electrode formed between an intermediate interconnection layer among the multiple interconnection layers and an inter-layer insulating film, and the pixel electrode is formed of an topmost interconnection layer among the multiple interconnection layers.

12. The LCD device according to claim 9, wherein the first switching unit is configured with a first transistor, the first holding unit is configured with first inverter and second inverter each of which output terminal is connected to input terminal of the other inverter, of the first inverter and second inverter, drive force of a second transistor configuring the first inverter at an input side from a view point of the first transistor is set to be larger than drive force of a third transistor configuring the second inverter at an output side from a view point of the first transistor, and drive force of the first transistor is set to be larger than the drive force of the third transistor configuring the second inverter.

* * * * *